US008585560B2

(12) United States Patent
Punchenko

(10) Patent No.: US 8,585,560 B2
(45) Date of Patent: Nov. 19, 2013

(54) DEVICE FOR DEVELOPING HAND MUSCLES

(76) Inventor: Olexander Punchenko, El Masnou (ES)

( * ) Notice: Subject to any disclaimer, the term of this patent is extended or adjusted under 35 U.S.C. 154(b) by 184 days.

(21) Appl. No.: 12/994,096

(22) PCT Filed: May 21, 2009

(86) PCT No.: PCT/ES2009/000290

§ 371 (c)(1),
(2), (4) Date: Jan. 27, 2011

(87) PCT Pub. No.: WO2009/144339

PCT Pub. Date: Dec. 3, 2009

(65) Prior Publication Data

US 2011/0124471 A1 May 26, 2011

(30) Foreign Application Priority Data

May 26, 2008 (ES) ..... 200801155 U

(51) Int. Cl.
*A63B 21/00* (2006.01)

(52) U.S. Cl.
USPC ..... 482/44; 482/49; 482/47; 482/148; 473/355; 473/375

(58) Field of Classification Search
USPC ..... 482/44, 49; 473/355, 375
See application file for complete search history.

(56) References Cited

U.S. PATENT DOCUMENTS

| | | | | |
|---|---|---|---|---|
| 6,241,637 | B1 | 6/2001 | Basyuk | |
| 7,223,207 | B1 | 5/2007 | Basyuk | |
| 8,117,690 | B1 * | 2/2012 | Larsson | 5/108 |
| 2009/0048071 | A1 * | 2/2009 | Basyuk | 482/49 |

OTHER PUBLICATIONS

International Search Report, Nov. 16, 2009, from International Phase of the instant application.

* cited by examiner

*Primary Examiner* — Jerome w Donnelly
(74) *Attorney, Agent, or Firm* — Jackson Patent Law Office

(57) ABSTRACT

The invention relates to a device for developing hands muscles, formed by a body comprising a partially or fully hollow container (1) fitted with an upper movable cover (2) having one hole or a series of holes provided at one o more points along the periphery thereof for the coupling of transparent flexible tubes (3) which are open at both ends. According to the invention, the lower end (4) of the tube (3) is used for the insertion of a part having a surface that is fully or partially covered, especially in the peripheral area thereof, with longitudinal segments in the forms of pins or needles (6) inclined in the same direction with a variable degree of inclination. The ends (8) os said longitudinal segments are kept in contact with the inner face or wall of the tube (3). The device can be used for therapeutic uses, as a piece of gym equipment or as a toy.

12 Claims, 4 Drawing Sheets

DEVICE FOR DEVELOPING HAND MUSCLES

AIM OF THE INVENTION

The utility model being presented is a device for developing hand muscles, applicable as a therapeutic measure to recover hand motor skills, and as a gym apparatus or play item. In all these cases it is, a device that significantly improves the existing state of the art and items currently available on the market.

Specifically, this innovation creates a device, whose aim is to provide a tool that, by squeezing and releasing a flexible hollow tubular component, which has a sliding piece inside that exerts resistance, allows complete hand movement to be forced, with particular participation of the fingers.

STATE OF THE ART

Currently there are some items whose aim is to exercise both the movement and the musculature of the hand, the most common being flexible balls that the user continually squeezes to exert a particular pressure. Other commonly used resources are elastic cords or spring loaded items.

Within the framework of industrial property, several patents have been drafted that include tools for exercising the hands and improving their strength and musculature. This is the case of utility model 0294838 that claims to be a hand exercise device consisting of a rigid frame covered in a shapeable elastic membrane with proper sized cells conformed for the fingers. U.S. Pat. No. 2,172,426 also develops a utensil for performing extension exercises and abduction of the fingers of the hand, which consists of a flexible elastic strip with orifices coinciding with the finger positions, enabling the hand musculature to be re-trained.

These proposals and other similar ones are centred basically on items for therapeutic and individual use, which limits and restricts their advantages.

Apart from what has been mentioned here, no device similar to the one described herein is currently know in the state of the art.

DESCRIPTION OF THE INVENTION

The invention described in this utility model is a device whose primary function is to act as a means for reinforcing the musculature of the hands, whether for medical reasons, i.e., recovery of motor strength in people with reduced mobility or strength, or with illnesses that diminish the motor capabilities of the fingers, such as occurs with the loss of sensation in people with diabetes, or to increase, musculature like other gym devices, or to be used for recreational purposes. In all these possible applications, the device is apt for children and adults of any age, with no limitations, and can be used individually or in groups.

Specifically, this device for developing muscular strength in the hand and fingers has been conceived as a device that focuses on the continuous repetition of two actions, squeeze and release, which requires concentrating the force specifically in the hand and very particularly in the joint action of all the fingers.

The device is structured around a central body, which is a container that is partially or completely hollow and optionally provided with a top cover enabling to access the inside. At one or more points of its perimeter, this container has one or more orifices into which similar flexible transparent tubular segments can be fitted and adjusted. These are open at both ends and can be fixed to the container like tentacles.

The second basic element of this device is a part that is of the proper size to be inserted inside the described tube. This piece is preferably elongated and cylindrical and its surface is completely or partially covered, particularly its perimeter, by long segments like spikes or needles, which are all positioned obliquely with respect to the piece itself, always all tilted in the same direction and able to vary the degree of inclination. The diameter and/or thickness of these needles can be varied. In their rest position these needles have an inclination of approximately between 80° and 88° with respect to the longitudinal axis of the cylinder or "hedgehog".

The operation of this device is very simple, and as has already been mentioned, is based on the continued repetitive squeezing and releasing of the tubular body using the hand and fingers. The aim is to defeat the resistance of the flexible tube and needles or flexible spikes on the cylinder, in a way that the cylinder is moved along the tube until the end is reached, and it falls into the container.

As stated, the cylindrical piece with spikes, or "hedgehog", is positioned inside the flexible transparent tube in such a way that each of the spikes or needles, when at rest, has its tip brushing the interior surface of the tube, thus acting as means for retaining the cylinder, which remains immobilised inside the tube. When the user applies a certain pressure, squeezing the point at which the cylinder is by hand, the flexible tube gives in, narrowing its original diameter, and pressing on the spikes or needles of the cylinder, which are flexible and therefore also give in and change their tilt angle to become approximately between 5°/18° degrees, pushing the cylinder forward.

At this moment, when the cylinder or "hedgehog" moves forwards, some of the needles, specifically those at the end, stay in contact with the tube's internal wall, acting as a means of retention and forcing the "hedgehog" to move exclusively forwards and not allowing it to move backwards. When the user releases the pressure applied by their hand, the flexible tube returns to its original diameter and, consequently, the spikes or needles also return to their original inclination and position, but at a point further down the tube with regard to the previous point. As this squeezing and releasing process is continuously repeated, the cylinder is moved along the described tube until it reaches the end, where it falls into the mentioned container.

As mentioned above, the number of flexible tubes varies, although four is considered a reasonable number to allow using the device in groups.

The container can take many shapes as long as the perimeter orifices for inserting the flexible tubes are maintained. In the same way, and with the aim of achieving maximum visibility, it is envisaged that the device as a whole, including the container may be transparent so that the movement of the cylinder can be observed and even its position inside the container, although it could likewise be opaque. At its bottom, the container could also include some means of anchoring it to a supporting surface or stand, such as a table or similar item, so that it stays fixed and immobilised under the pressure and force applied on its various tubes or tentacles.

The device can incorporate electronic or other elements such as optics or sounds, which enable to monitor the position and movement of the cylinders or "hedgehogs", the time intakes to move it or other variables.

The cylindrical parts or "hedgehogs", whilst maintaining a basically cylindrical shape, can take on, particularly and their ends, different shapes, imitating animals, objects etc., or can be painted in different colours. For example, one possibility is to imitate heads and animal tails, which is particularly applicable when used as a game.

As per this description, it is obvious that the claimed device has many advantages over other similar devices; it is useful, from a recreational point of view, both for personal enjoyment and for competing against other people; it enables to exercise the musculature of both hands simultaneously, which is particularly important in cases of recovering motor skills or muscular dysfunction in people showing an imbalance between the right and left sides of the body; it is equally effective as a gym equipment; it can be used by adults or children, where the only difference is the length or thickness of the needles or spikes, as the thicker they are, the greater their resistance, and the thinner, the lower their resistance, which means it can be adapted to levels of force for children, women or men. At this point is should be noted that the thickness and diameter of the tube, and its degree of flexibility can be varied according to the end user in order to increase its degree of resistance when squeezed. Likewise, the perimeter orifices of the container include the adjustment means needed to attach tubes of different diameters, making these interchangeable so that the user can change them to carry out exercises at different levels.

DESCRIPTION OF THE DRAWINGS

To better understand what is described in this patent, a set of drawings are attached, which should only be analysed and considered as examples, with no intention to limit or restrict.

DESCRIPTION OF A PREFERRED EMBODIMENT

Figure 1:
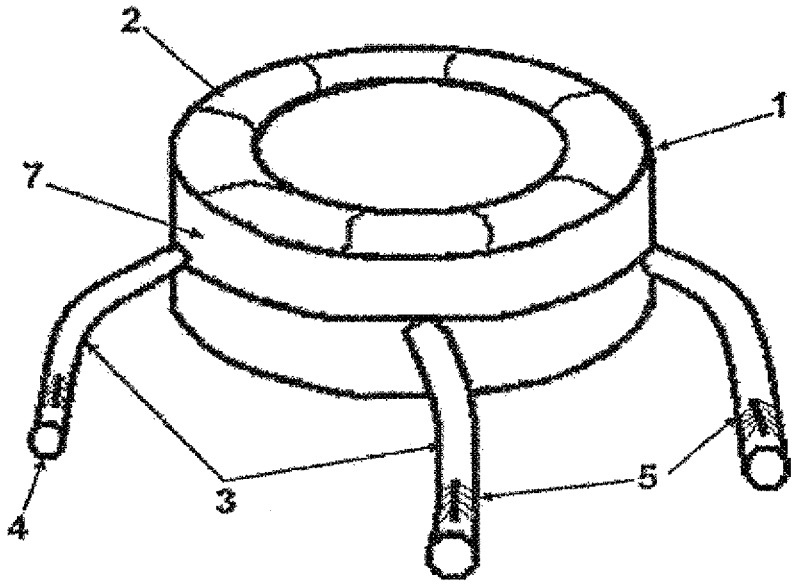
FIG. 1.—View of the muscle training device

These figures show the configuration of the claimed muscle exercising device, which, as can be seen in FIG. 1, is comprised of a body acting as a container (1) that is partially or totally hollow and optionally provided with a removable top lid (2) or dome that allows access to the inside. At one or more points of its perimeter, the container (1) includes a series of orifices into which flexible and, transparent tubes (3) are coupled, and are open at both ends.

Through the lower end (4) of the tube (3), the second element of the device is inserted, which is a preferably elongated and cylindrical piece (5), with its surface completely or partially covered, and particularly its perimeter, with long segments such as spikes or needles (6). These spikes (6), which can be seen in greater detail in FIG. 2, are positioned obliquely with respect to the cylinder (5), with an approximate degree of inclination between 80° and 88° with respect to the cylinder's (5) longitudinal axis.

Figure 2:
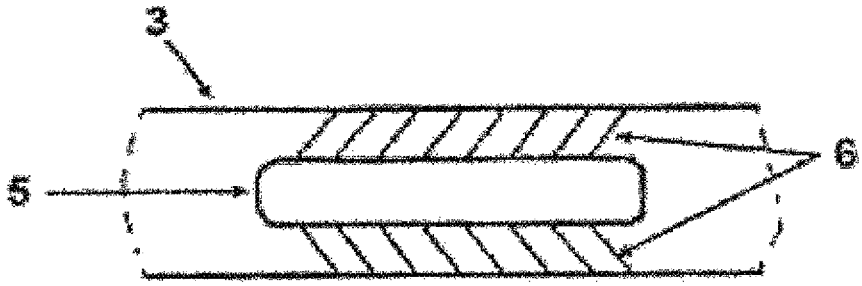
FIG. 2.—Detailed view of the mobile element or cylinder at rest
Figure 3:
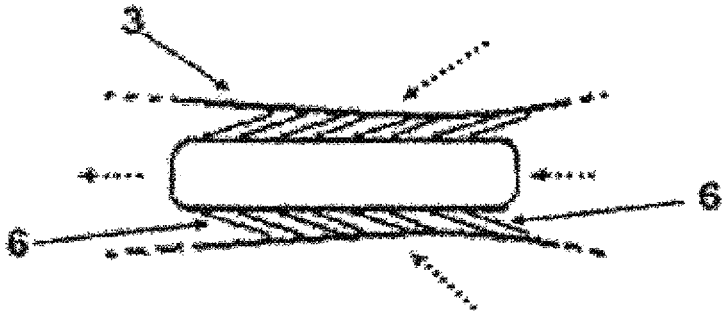
FIG. 3.—Detailed view of the mobile element or cylinder in the forwards moving position FIG. 4.—Detailed view of the advancing process of the mobile element or cylinder

FIG. 2 and FIG. 3 show the detail of this cylinder (5), which in FIG. 2 is in the rest position, so the end of each spike or needle (6) rubs and is in contact with the inside of the tube (3), acting as a means of retention for the piece that is fixed and immobile.

FIG. 3 shows how squeezing and releasing the flexible tube (3) makes it give in and in turn presses on the cylinder (5), forcing the spikes or needles (6) to change their degree of inclination, which becomes approximately between 5° and 18° with respect to the cylinder's (5) longitudinal axis. At this time, the cylinder (5) moves and shifts. When pressure on the flexible tube (3) is no longer applied, the tube returns to its original diameter and the spikes (6) on the cylinder (5) also return to their original inclination, as can be seen in the aforementioned FIG. 2.

Figure 4:
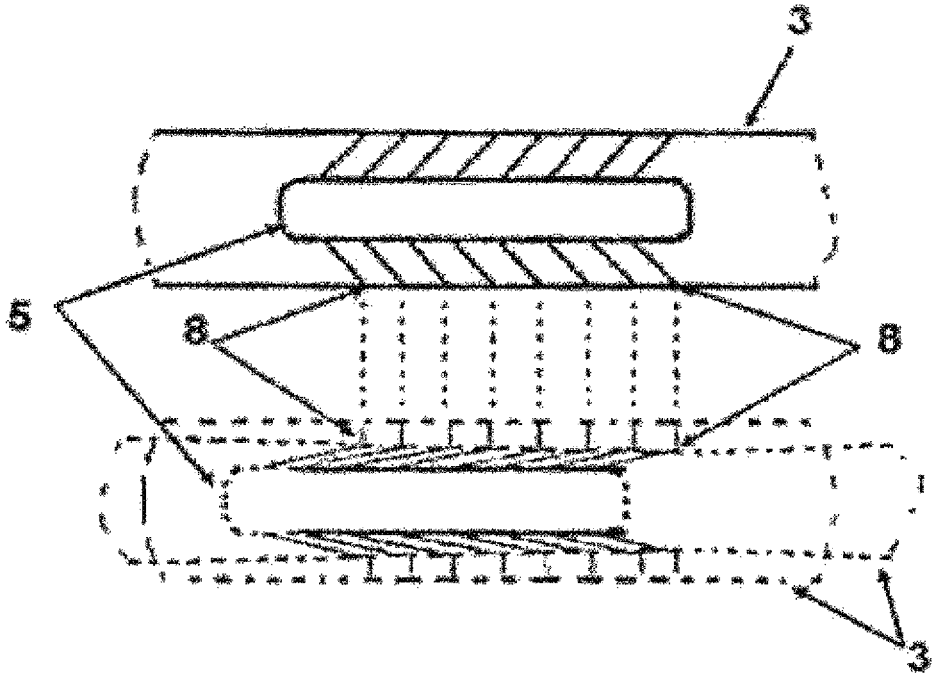

FIG. 4 shows, in a comparison of the flexible tube (3) and the cylinder (5) in the rest or released position, at the top, and in a squeezed position at the bottom, how the tips (8) of the needles or spikes (6) are kept in contact with the inner wall or face of the tube (3) at the same point, acting as a means of retention and forcing the cylinder (5) to always move forward. Also visible in FIG. 4 is the advance movement of the cylinder (5) inside the flexible tube (3). By squeezing the cylinder (5), it stays in the advanced position thanks to the needles or spikes (6) that do not change their degree of inclination and thus stop the cylinder (5) from moving backwards.

It is not considered necessary to provide a more detailed description so that any expert in the field can understand the scope of the invention and, the advantages derived from it. The materials, form, size and layout of the elements can be varied provided that this does not alter the essential nature of the invention. The terms in which this report has been written should always be understood in a broad sense and not a limiting one.

The invention claimed is:

1. A device for developing hands muscles, the device comprising:

a central body defining a hollow, the central body thus acting as a container, the central body defining a plurality of orifices;

a plurality of flexible transparent tubes, each flexible transparent tube defining a longitudinal axis, a proximal end attached to the central body and a distal end, each flexible transparent tube being open at the proximal and distal ends;

a plurality of moving parts, each moving part being in one of the transparent tubes, each moving part including a body, and a plurality of projections, each projection defining a proximal end attached to the body, and a distal end in contact with corresponding transparent tube, wherein the proximal end of each projection defines a first distance from the proximal end of the corresponding transparent tube, and the distal end of the projection defines a second distance from the proximal end of the corresponding transparent tube, the second distance being greater than the first distance, the projection being configured to vary a degree of inclination with respect to the longitudinal axis of the corresponding transparent tube while in contact with the corresponding transparent tube, the moving part being thereby configured to move toward the proximal end of the corresponding transparent tube when the corresponding transparent tube is compressed by a user.

2. A device for developing hands muscles, according to claim 1, wherein the body of each moving part defines a longitudinal axis, and the projections have a rest position of between approximately 80° and 88° with respect to the longitudinal axis of the body.

3. A device for developing hands muscles, according to claim 1, wherein the body of each moving part defines a longitudinal axis, and the projections have a position of between approximately 5° and 18° with respect to the longitudinal axis of the body when the user compresses the corresponding transparent tube.

4. A device for developing hands muscles, according to claim 1, wherein the thickness and diameter of the tubes and their degree of flexibility is variable and the central body includes, in the orifices, an adjustment means for attaching different diameter tubes.

5. A device for developing hands muscles, according to claim 1, wherein a thickness and a diameter of the projections is variable.

6. A device for developing hands muscles, according to claim 1, wherein the moving parts can adopt different shapes.

7. A device for developing hands muscles, according to claim 1, wherein the central body is transparent.

8. A device for developing hands muscles, according to claim 1, wherein the central body includes a screen.

9. A device for developing hands muscles, according to claim 1, further including a monitor configured to monitor a position of the moving parts.

10. A device for developing hands muscles, according to claim 1, further including a removable top lid that enables access to an interior of the central body.

11. A device for developing hands muscles, according to claim 1, wherein the body of each moving part is elongated.

12. A device for developing hands muscles, according to claim 1, wherein a moving part imitates an animal head.

* * * * *